US009987762B2

(12) United States Patent
Capone

(10) Patent No.: US 9,987,762 B2
(45) Date of Patent: Jun. 5, 2018

(54) SLICING MACHINE

(71) Applicant: Bizerba SE & Co. KG, Balingen (DE)

(72) Inventor: Timo Capone, Balingen (DE)

(73) Assignee: Bizerba SE & Co. KG (DE)

( * ) Notice: Subject to any disclaimer, the term of this patent is extended or adjusted under 35 U.S.C. 154(b) by 0 days. days.

(21) Appl. No.: 15/274,708

(22) Filed: Sep. 23, 2016

(65) Prior Publication Data

US 2017/0106557 A1 Apr. 20, 2017

(30) Foreign Application Priority Data

Oct. 16, 2015 (EP) ..... 15190239

(51) Int. Cl.

| | |
|---|---|
| ***B26D 7/30*** | (2006.01) |
| ***B26D 7/32*** | (2006.01) |
| ***B26D 7/06*** | (2006.01) |
| ***B26D 1/15*** | (2006.01) |
| *B26D 7/00* | (2006.01) |

(52) U.S. Cl.

CPC ..... *B26D 7/30* (2013.01); *B26D 1/15* (2013.01); *B26D 7/0616* (2013.01); *B26D 7/32* (2013.01); *B26D 2007/0018* (2013.01); *B26D 2210/02* (2013.01)

(58) Field of Classification Search

CPC ..... B26D 7/30; B26D 7/32; B26D 7/0616; B26D 1/15; B26D 2007/0018; B26D 2210/02

USPC ..... 83/707, 435.11, 435.21

See application file for complete search history.

(56) References Cited

U.S. PATENT DOCUMENTS

| | | | | |
|---|---|---|---|---|
| 4,813,316 | A * | 3/1989 | Johnson | B26D 7/0616 83/365 |
| 5,649,463 | A * | 7/1997 | Lindee | B26D 1/0006 83/174 |
| 8,844,417 | B2 * | 9/2014 | Koch | B26D 7/00 83/435.11 |
| 2003/0200848 | A1 * | 10/2003 | Kuchler | B26D 5/34 83/13 |
| 2005/0045007 | A1 * | 3/2005 | Mueller | B26D 5/00 83/13 |
| 2005/0092153 | A1 * | 5/2005 | Kuchler | B26D 5/00 83/478 |
| 2005/0115378 | A1 * | 6/2005 | Kuchler | B26D 7/02 83/707 |
| 2009/0071310 | A1 * | 3/2009 | Rummel | B26D 7/22 83/707 |
| 2009/0133588 | A1 * | 5/2009 | Rummel | B26D 5/26 99/537 |

(Continued)

*Primary Examiner* — Omar Flores Sanchez

(74) *Attorney, Agent, or Firm* — Lerner, David, Littenberg, Krumholz & Mentlik, LLP

(57) ABSTRACT

A slicing machine for preferably elongated food may include a blade driven by a motor and a deposit table arranged in a deposit area with a deposit plate, which can be moved, motor-driven, linearly in a horizontal direction via a belt drive. In order to manufacture the slicing machine as compactly as possible with a small overall height, it is proposed that the belt drive has at least two deflection rollers and a driving roller, which guide the drive belt in endless rotation in a horizontal plane, and that the driving roller is arranged in a perpendicular projection between the first deflection roller and the second deflection roller.

21 Claims, 6 Drawing Sheets

(56) References Cited

U.S. PATENT DOCUMENTS

2009/0173201 A1* 7/2009 Zhu ..... B26D 7/0616
83/474

* cited by examiner

SLICING MACHINE

CROSS-REFERENCE TO RELATED APPLICATIONS

This application claims the benefit of the filing date of European Patent Application No. EP15190239.2 filed Oct. 16, 2015, the disclosure of which is hereby incorporated herein by reference.

FIELD

The invention relates to a slicing machine for elongated products to be sliced, preferably for food, according to the features of the preamble of claim 1.

BACKGROUND

Such a slicing machine is known from DE 10 2013 203 261 A1. There a slicing machine for elongated food is shown which, in its deposit area for the cut slices, has a depositing system carrier to which, among other things, a deposit table can be secured. The deposit table can be moved horizontally via a belt drive mechanism. The belt drive mechanism is arranged underneath the deposit table and has a belt drive consisting of two drive belts arranged one above the other vertically. A first drive belt is connected to a driving motor. The second drive belt is connected, via a gearing mechanism, to the first driving motor and, on the output side, to the deposit table. The deposit table is fitted onto a housing of the belt drive mechanism at the top. This design has the disadvantage that it has a relatively large overall height. As a result, it can be difficult, above all for shorter machine operators, to operate the slicing machine when it is installed on a sales counter.

Furthermore, from practical experience, slicing machines with horizontally adjustable tables are known which have a spindle drive or a toothed rack for adjusting the table. Such drive mechanisms are difficult to clean and are therefore disadvantageous from the point of view of hygiene.

SUMMARY

The object of the invention is to create a slicing machine for food which has a horizontally adjustable deposit table which meets high hygiene requirements, is easy to operate and is constructed to be as compact as possible, in particular has a small overall height.

This object is achieved according to the invention by a slicing machine with the features of claim 1.

According to the invention it is provided that the belt drive has at least two deflection rollers and a driving roller, which drive the drive belt in endless rotation in a horizontal plane, and that the driving roller is arranged in a perpendicular projection between the first deflection roller and the second deflection roller. A compact construction is achieved by this arrangement and design of the belt drive. The belt drive runs in only one horizontal plane and comprises only a single drive belt. The belt drive therefore has a small overall height.

In particular it can be provided that the connecting lines between the driving roller and the first deflection roller and the second deflection roller form a triangle. The driving roller is arranged laterally offset with respect to a direct connecting line between the first deflection roller and the second deflection roller. The driving roller and the first deflection roller and the second deflection roller are arranged in the corners of the triangle. The triangle spanned by the connecting lines between the driving roller and the first deflection roller and the second deflection roller has an internal angle smaller than 90° in each case at the first deflection roller and at the second deflection roller.

In an embodiment it is preferably provided that the drive belt is driven in a substantially T-shaped rotation, by the belt drive also having a third deflection roller and a fourth deflection roller, which are arranged in a perpendicular projection between the first deflection roller and the second deflection roller. In a preferred embodiment, the drive belt of the belt drive can be formed as a flat drive belt or as a toothed belt.

In an embodiment it can be provided that the deposit plate is spaced apart from the deposit plate carrier in a vertical direction, with the result that the deposit table has an installation space arranged between the deposit plate carrier and the deposit plate, and the belt drive and/or the drive belt is arranged in the installation space and/or encroaches into the installation space. It is provided in particular that the deposit table itself forms an installation space for receiving the belt drive. This prevents the need to make an additional installation space, which means an additional overall height, available for the belt drive. It is thus possible to design the deposit table relatively flat and thus to keep the overall height of the slicing machine as a whole small. A deposit table designed flat also makes it possible for short people to operate the slicing machine, even if it is raised up on a sales counter.

It is provided that the slicing machine has a driving motor, housed in a machine housing, for driving a blade mounted in or on the machine housing. By the motor-driven blade, slices are cut off the preferably elongated product to be sliced. The cut slices are deposited on a deposit table in a deposit area of the machine housing. The deposit table comprises a deposit plate carrier and a deposit plate designed so that it can be removed from the latter. The deposit plate has a flat surface so that cut slices can be deposited on the surface of the deposit plate. Via a table drive mechanism, which comprises at least one horizontal drive mechanism, the deposit table or the deposit plate can be moved, motor-driven, linearly in a horizontal direction. In order to facilitate as quiet as possible a drive, the horizontal drive mechanism has a belt drive with a drive belt.

It is provided in particular that the blade of the slicing machine is arranged in a slicing plane. The product to be sliced is fed or conveyed to the slicing plane manually and/or automatically in order to cut slices off the product to be sliced using the blade. The deposit area is arranged behind the blade, i.e. is arranged on the side of the blade facing away from the product to be sliced. The horizontal drive mechanism moves the deposit table or the deposit plate in a horizontal direction parallel to the slicing plane. Different deposit shapes, for example a shingled deposit pattern, can be achieved with the deposited slices using the horizontal drive mechanism.

The slicing machine can be formed for example as a slicer or as a vertical slicer or as a gravity feed slicer. A slicer has a device for conveying products to be sliced, in which several strands of product to be sliced which are arranged in parallel are as a rule conveyed to the slicing plane in a motor-driven manner in a linear direction. As a rule, with one cut, the slicing machine cuts a slice off each of the parallel strands of product to be sliced. The cut slices then fall onto the deposit plate of the deposit table in a deposit area. A slicer has no sliding carriages which can be moved parallel to the slicing plane, as is usual for example in the case of a vertical slicer or a gravity feed slicer.

In a vertical slicer or in a gravity feed slicer, a sliding carriage for positioning elongated product to be sliced is provided which is mounted on a machine housing so that it can be moved, manually or motor-driven, parallel to the slicing plane. Behind the blade, the cut slices are deposited on the deposit plate of the deposit table in the deposit area, conveyed either manually or via a conveyor. In a vertical slicer the blade, and thus the slicing plane, is arranged vertically. In a gravity feed slicer the blade, and thus the slicing plane, is arranged tilted relative to the vertical by a particular angle, as a rule tilted by between 10° and 30°. In practice a slicer has a very high cutting power and is used in industrial sausage processing. A vertical slicer or a gravity feed slicer has a lower cutting power and is usually used in the sale of fresh products.

In an embodiment it can be provided that the belt drive has a housing which encloses the drive belt guided in endless rotation in a horizontal plane over at least two deflection rollers and a driving roller, and holds the driving roller and the at least two deflection rollers. The housing is preferably designed closed, with the result that the belt drive or components of the belt drive are protected against soiling. A hygienically sound operation of the slicing machine is thus made possible. In particular it is provided that the housing of the belt drive holds the deposit table with the deposit plate carrier and the removable deposit plate.

In a preferable embodiment it is provided that the deposit plate carrier has at least two holders, preferably has three holders or four holders, which extend in a vertical direction starting from the deposit plate carrier and which releasably hold the deposit plate, the deposit plate being able to be placed on the holders from above and/or being able to be releasably connected and/or coupled to one or more of the holders. The holders are formed in particular as spacers and hold the deposit plate at a distance above the deposit plate carrier. An installation space thereby forms between the deposit plate carrier and the deposit plate. The deposit plate can be formed from a metal or an alloy, preferably from stainless steel or from aluminum, or from a plastic. The deposit plate has a flat surface on which the cut slices of the product to be sliced are placed. In order to enable a hygienically sound operation, it is necessary to clean the deposit plate now and then. Due to the releasable hold of the deposit plate, the latter can be easily removed from the slicing machine and cleaned.

It is preferably provided that the holders have a connection or coupling which can be released without tools in order to hold the deposit plate. This connection and/or coupling can be formed for example as a bridgeable snap-in connection or as a form-fitting connection or as a magnetic connection. It is not necessary for each of the holders to have a releasable coupling and/or a releasable connection. For example a total of four holders can preferably be provided, of which at least one, preferably two, holders are equipped with a releasable connection and/or have a releasable coupling.

In an embodiment it can be provided that the belt drive has a tensioning device for adjusting the belt tension. The tensioning device comprises a third deflection roller and a fourth deflection roller, wherein the position of the third deflection roller and/or the position of the fourth deflection roller can be adjusted relative to the drive belt via a tensioning screw. It can be provided that the tensioning device has a displaceable adjustment plate, on which the third deflection roller and the fourth deflection roller are arranged. The tensioning device is mounted inside the housing of the belt drive. In order to adjust the tension of the drive belt, either one deflection roller, for example the third deflection roller or the fourth deflection roller or both deflection rollers, can be displaced via the tensioning screw, or the adjustment plate can be displaced.

In order to achieve a small overall height, in an embodiment it can furthermore be provided that the drive belt and the at least two deflection rollers and the driving roller and/or the housing of the belt drive are arranged flush with the at least two holders in a horizontal plane.

In an embodiment it is provided in particular that the machine housing has a substantially rectangular base or frame, which is formed closed at the top and is arranged in the lower area of the machine housing. Housing feet can be provided on the base of the machine housing to mount the slicing machine on a flat support. The base of the machine housing can have, on its inside, an installation space for receiving individual or several components of the slicing machine, such as for example driving motors or electronic control devices. The machine housing is covered, on its underside, by a removable plate. Removing the plate makes the installation space located inside the base of the machine housing accessible, with the result that the components mounted therein can be serviced or replaced if necessary. The base of the machine housing is formed closed towards the top, with the result that soiling originating from the product to be sliced cannot reach the inside of the machine housing. The upper side of the base has, at least in sections, a flat, horizontally running surface, wherein it is preferably provided that the deposit plate is arranged above the base or above this horizontally running surface.

In order to achieve a good slicing result, it can be provided that the table drive mechanism comprises a vertical drive mechanism, in order to alter, motor-driven, the height of the deposit plate relative to the machine housing. If a plurality of slices are cut off in succession during the slicing, a stack of slices forms on the deposit table or on the deposit plate. The height of the stack of slices increases, which has the result that the path of the slices from the blade to the deposited stack shortens. This path can be kept constant using a vertical drive mechanism, with the result that a stack formation of the slicing machine is improved.

In an embodiment it is provided in particular that the vertical drive mechanism has a telescopic carrier and the housing of the belt drive is connected to the machine housing via the telescopic carrier. It is preferably provided that the vertical drive mechanism has a vertical driving motor which is connected to the telescopic carrier such that the length of the telescopic carrier can be altered by motor. The housing of the belt drive, and thus the deposit table held by the housing of the belt drive, is thus held on the telescopic carrier and connected via the latter to the machine housing. It is provided that the telescopic carrier has an internal shaft for driving the belt drive. The length of the telescopic carrier, and thus the height of the deposit table or of the deposit plate, can be altered or set for example via a worm drive mechanism or a rack-and-pinion drive mechanism.

In a further embodiment it can be provided that the horizontal drive mechanism has a horizontal driving motor which is connected to the driving roller of the belt drive via a shaft, wherein the shaft is preferably guided inside the telescopic carrier. In particular the shaft can be formed as a telescopic shaft. In particular the table drive mechanism, thus the drive mechanism of the deposit table, can comprise both a horizontal drive mechanism and a vertical drive mechanism, in order to guarantee the most optimum slicing result possible. Both the horizontal drive mechanism and the vertical drive mechanism can be operable in a motor-driven manner. For the drive mechanism of the horizontal drive mechanism and/or of the vertical drive mechanism, a stepper motor can be used in each case, in order to control an exact position of the deposit table or of the deposit plate. Alternatively, position sensors can also be provided which detect the position of the deposit plate or of the deposit table in order to enable an exact positional control or positioning control via an electronic control of the driving motors.

In a further embodiment it can be provided that the horizontal driving motor and the vertical driving motor are arranged underneath the deposit plate and housed in an internal space of the machine housing, preferably that the horizontal driving motor and the vertical driving motor are connected to each other via a common motor carrier and secured in or on the machine housing, preferably by screwing. The connection between the two driving motors on a common motor carrier can on the one hand simplify the assembly effort and on the other hand further reduce the required space. Both motors are arranged inside the machine housing, i.e. in a space protected from soiling. It is advantageous in particular that both motors are immovable and there is no need to move either the horizontal driving motor or the vertical driving motor when the deposit table or the deposit plate is moved. This reduces the necessary installation space on the one hand and the driving forces required for a movement on the other hand.

In an embodiment it can be provided that the deposit table has a support profile for holding the deposit carrier, and the deposit plate carrier is secured directly to the support profile, for example by screwing or riveting. A mechanically stable structure with, at the same time, a small overall height thereby results. Alternatively, it can be provided that the deposit plate carrier is formed as one piece with the support profile.

In an advantageous embodiment of the slicing machine it can be provided that, during the slicing, the weight of the product to be sliced is detected, for example by it being provided that the deposit table comprises a support profile and a load cell connected to the support profile and the deposit plate carrier is mounted on or against the load cell, preferably is connected to a force application side of the load cell. The load cell can be formed as a strain gage load cell or as an electromagnetic force compensation load cell or as a vibrating wire load cell. The slicing machine preferably has a display for displaying the weight value measured by the load cell. An electrical connection of the load cell can be guided into the machine housing via the telescopic carrier. With the load cell, the weight of the cut slices can be determined already while the product to be sliced is being sliced. Wastage because of too many slices being cut off accidentally can thus be effectively prevented.

In order to achieve a particularly compact structure, it can be provided that in its central area the deposit plate carrier has an upwardly directed bulge and the load cell is arranged such that it at least partially encroaches into the space formed by the bulge, preferably that the load cell is arranged with its upper edge inside the space formed by the bulge. The load cell is thus arranged inside the deposit table in its own installation space, without a separate installation space outside the deposit table having to be made available for the load cell. The bulge can be formed for example by multiple bending of the deposit plate carrier formed as a flat plate.

The load cell can be designed to be modular. In other words, instead of the load cell, for example a spacer can be inserted into the installation space provided, between the support profile and the deposit plate carrier, and thus the slicing machine can be delivered without a weighing function. If an upgrade of the slicing machine is to be made after delivery, this can be easily carried out by replacing the spacer with a load cell. The slicing machine can thus be easily upgraded to have a weighing function.

Further, in an embodiment it can be provided that the housing of the belt drive is arranged directly underneath the deposit plate and above the deposit plate carrier, preferably above the load cell. The top of the housing preferably runs horizontally and in parallel to the removable deposit plate, in order to enable an arrangement that saves as much space as possible.

In order to reduce torsion of the deposit table and preferably to reduce the sensitivity of the load cell to corner loads, it can be provided that the support profile is mounted on the housing of the belt drive so that it can be displaced in a horizontal direction by means of two rods which are arranged spaced apart from each other in a vertical direction and running in parallel. Via the two rods spaced apart from each other in a vertical direction, a mechanically stable mount of the support profile, and thus of the deposit plate, on the housing of the belt drive is made possible. Further, to improve the mechanical stability, it can be provided that the upper rod is formed as a slide rod and is connected to a run of the drive belt and the lower rod is formed as a torque rod which absorbs or braces against a torque and which is mounted, so that it can be displaced, in a recess of a linear guide supported on the housing of the belt drive.

In order to enable a convenient and automated operation of the slicing machine, in an embodiment it can be provided that the slicing machine has a conveyor for the cut slices, in order to transport the cut slices, starting from the blade, in a horizontal direction transverse to the slicing plane defined by the blade. The conveyor can be formed for example as a chain frame with a pivotable flick ejector. The conveyor preferably has its own drive mechanism, in order to transport or deposit the cut slices in the deposit area in a motor-driven manner. This enables a largely automatic operation of the slicing machine and reduces the manual manipulations necessary for operation.

In order to make a visually appealing slicing pattern possible, in an embodiment it can be provided that an adjustable and/or programmable control device is connected to the horizontal drive mechanism and the conveyor, and preferably to the vertical drive mechanism, and actuates the horizontal drive mechanism and the conveyor, and preferably the vertical drive mechanism, to automatically deposit two-dimensional depositing shapes. Via the conveyor, preferably via the chain frame, the cut slices can be moved transverse to the slicing plane. Via the horizontal drive mechanism, the cut slices can then be moved perpendicular thereto, thus in parallel to the slicing plane. The control device can thus control almost any two-dimensional depositing shape by controlling the horizontal drive mechanism and the conveyor. For example different depositing shapes, for example circles or ellipses or several parallel deposited rows, can thus be formed from several slices. Via the vertical drive mechanism, the precision of the depositing pattern can be further improved by adjustment of the drop height of the individual slices.

The slicing machine according to the invention can be used in industrial food processing, for example in sausage, meat or cheese processing. The slicing machine can cut off individual slices of an elongated food before they are then packaged as portions. The slicing machine according to the invention can likewise be used in the sale of fresh products, for example for slicing sausage or cheese on a sausage counter or a cheese counter.

BRIEF DESCRIPTION OF THE DRAWINGS

Further embodiments and features of the invention are shown in the figures and explained in the description of the figures. There are shown in.

DETAILED DESCRIPTION

Figure 1:
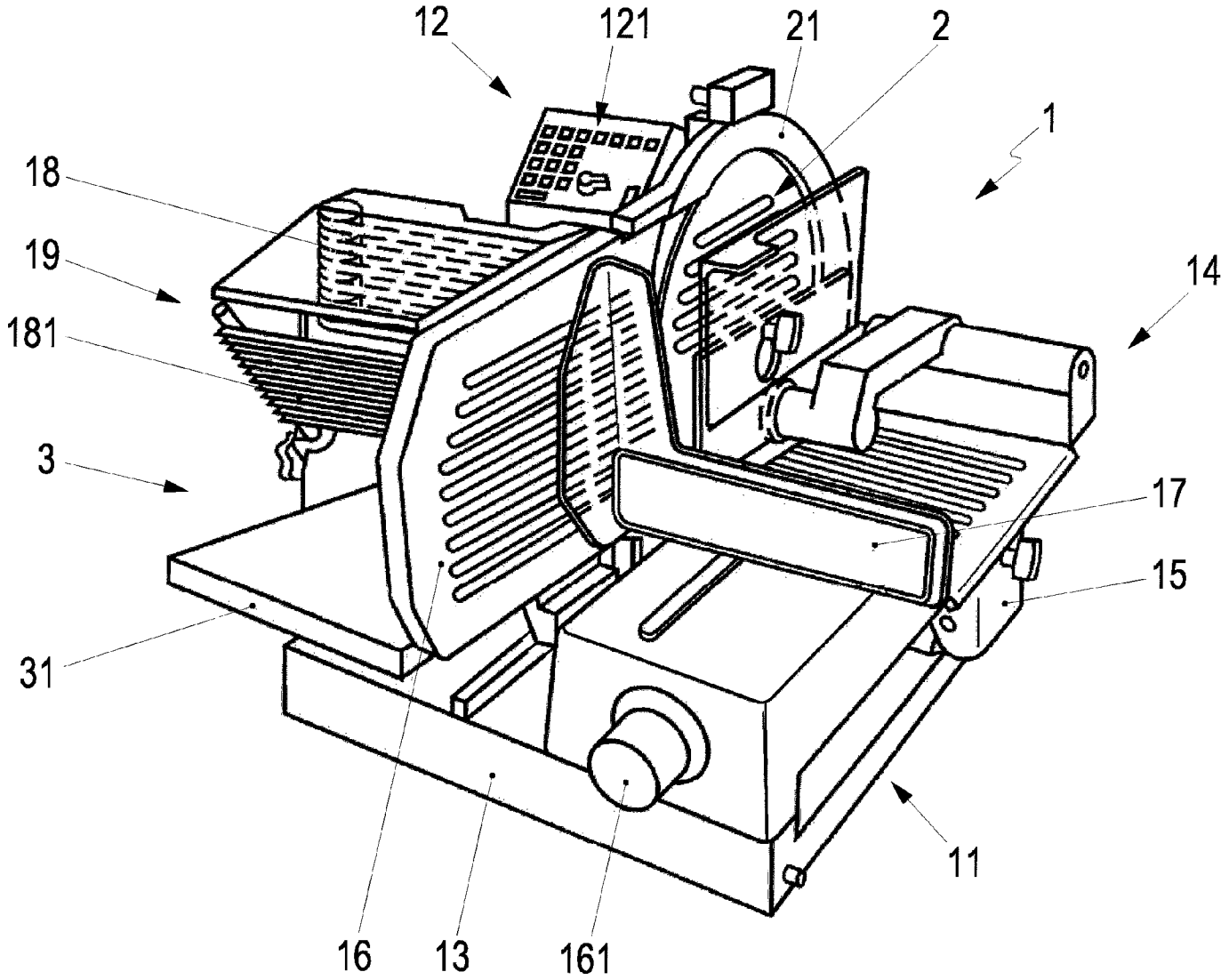
FIG. 1: a schematic view of a slicing machine according to the invention

In FIGS. 1 to 6 an embodiment example of the slicing machine 1 according to the invention in the form of a vertical slicer is represented. As can be seen in FIG. 1, the slicing machine 1 has a machine housing 11 with a motor tower 12. A motor, not shown, for driving the blade 2 is housed in the motor tower 12. The blade 2 is covered, in the area of its cutting edge, by a C-shaped blade guard ring 21, in order to prevent unintentional contact with the cutting edge of the blade.

The blade 2 is formed as a rotating circular knife and arranged in a slicing plane. The area of the blade 2 left free by the blade guard ring 21 defines the slicing area. In front of the slicing area a stop plate 16 which can be displaced in parallel to the blade 2 is mounted on the machine housing 11. Via a handle 61 the stop plate 16 can be adjusted in parallel to the slicing plane in order to set the cutting thickness, and thus to set a desired slice thickness.

A sliding carriage 14 which can be displaced in parallel to the slicing plane is arranged in the area in front of the blade 2. The sliding carriage 14 is mounted, so that it can be displaced linearly, via a slide foot 15 in the machine housing 11. In the front area, the sliding carriage 14 has a hand guard 17. Product to be sliced is raised onto the surface of the sliding carriage 14 and fed to the blade 2 by movement of the sliding carriage 14 back and forth. The hand guard 17 arranged in the front area of the sliding carriage is designed to be partially transparent, in order to guarantee a view into the slicing area.

The slices cut by the blade 2 are received, behind the blade, by a chain frame 18 and conveyed transverse to the slicing plane. Via a pivotable flick ejector 181 the cut slices are removed from the chain frame 18 and deposited on the deposit plate 31 of the deposit table 3 in the deposit area 19. The deposit plate 31 is arranged above a base 13 of the machine housing 11. The base 13 of the machine housing 11 is formed substantially rectangular and to all intents and purposes forms the frame of the machine housing 11. Height-adjustable machine feet, not shown, with which the slicing machine 1 can be positioned on a support, are arranged on the underside of the machine housing 11, thus in the area of the base 13. On the inside, the machine housing 11 has a receiving space for receiving individual components, such as for example driving motors and/or control devices. The base 13 of the machine housing is sealed to the top and has a removable cover plate on the underside. Starting from the base 13, the motor tower 12 extends upwards in a vertical direction. The driving motor and a control, not shown, for the slicing machine are arranged in the motor tower 12. An operating and/or display device 121 with operating elements and a display are arranged on the top of the drive tower or motor tower 12. Via this operating and/or display device, the slicing machine 1 can be adjusted or programmed and operated.

The deposit table 3 has a table drive mechanism via which the deposit table or the deposit plate 31 can be moved in a horizontal direction in parallel to the slicing plane and also in a vertical direction towards the chain frame or away from the chain frame. The table drive mechanism and the deposit table, in each case with individual ones of their components, are represented in FIGS. 2 to 6.

The deposit table 3 comprises, in addition to the deposit plate 31, a deposit plate holder 32, which is releasably connected to the deposit plate 31 via four holders 331, 332, 333, 334. Further, the deposit table 3 comprises a support profile 34, on which a load cell 7 is arranged. The deposit plate holder 32 is connected to the force application side of the load cell 7. The load cell is formed as a strain gage load cell. It has a rectangular box-shaped bending beam made from an aluminum alloy. One end of the load cell 7 is fixed, formed as a so-called ground side 71. The opposite end of the load cell is the force application side 72 of the load cell. In the middle between the ground side 71 and the force application side 72, the load cell 7 has a weakening zone 73. The strain gage sensors are arranged in the area of the weakening zone 73 in order to measure a weight-proportional deformation of the load cell 7.

The horizontal drive mechanism 4 of the table drive mechanism 6 has a belt drive 47 with a housing 46. The deposit table 3 is held on the housing 46 of the belt drive 47, by the support profile 34 being mounted, so that it can be displaced linearly, via two parallel rods 351, 352 on the housing 46 of the belt drive 47. The housing 46 of the belt drive 47 is mounted, height-adjustable, via a telescopic carrier 52 on the base 13 of the machine housing 11.

Figure 5:
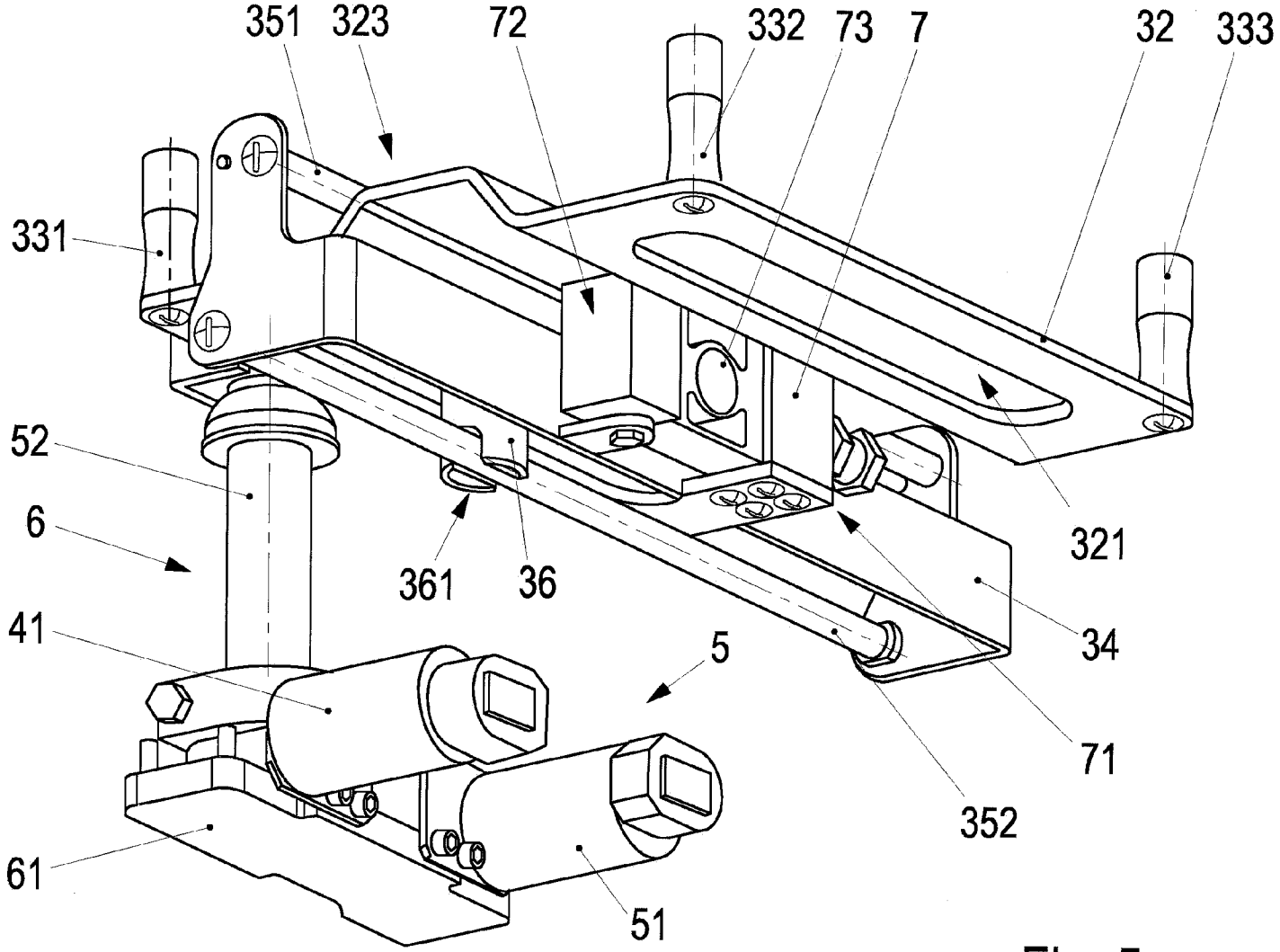
FIG. 5: a part of the deposit table with table drive mechanism in a perspective representation viewed from below
Figure 6:
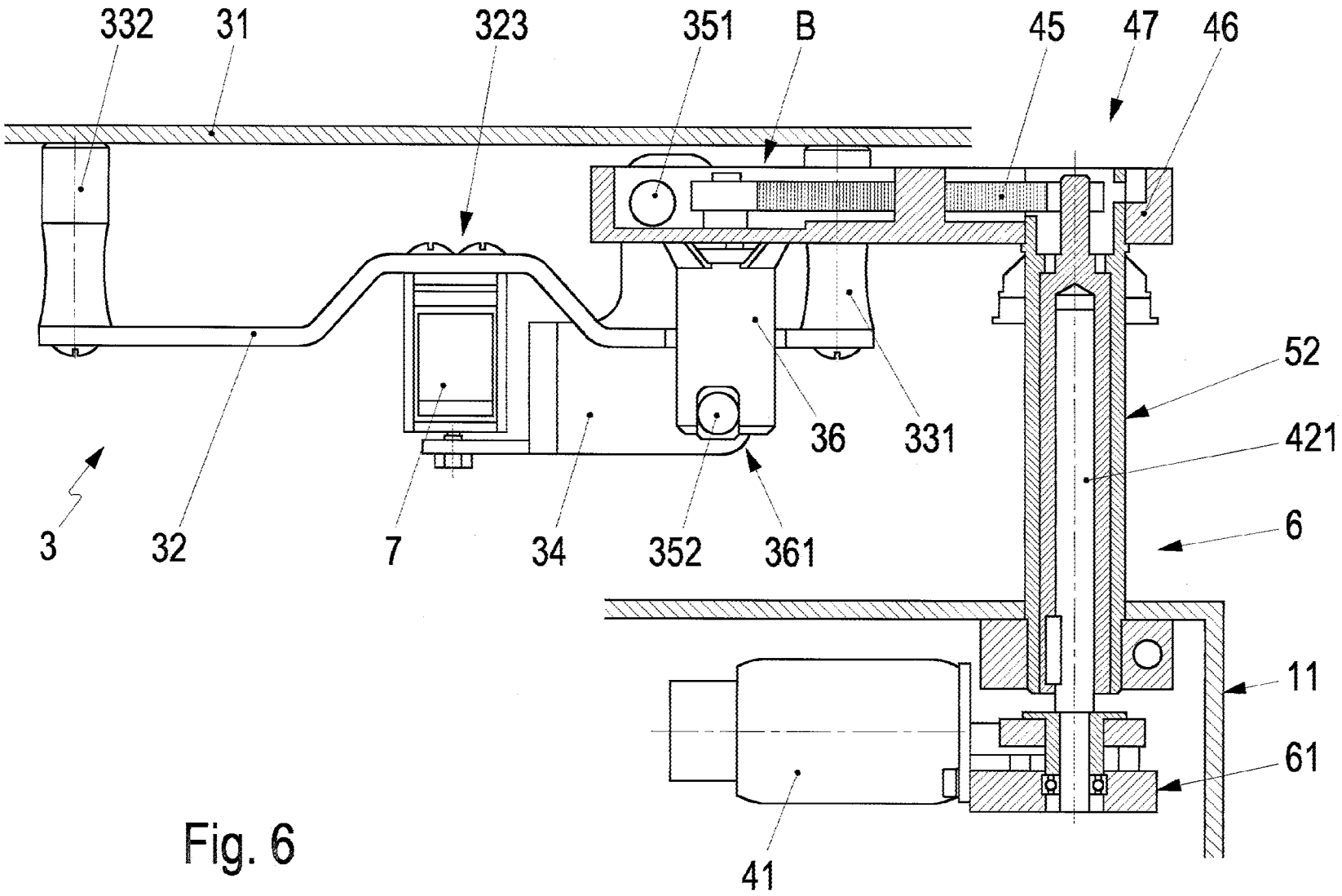
FIG. 6: a sectional representation of the deposit table in the area of the table drive mechanism

The table drive mechanism 6 has, as represented in FIG. 5 among others, a horizontal driving motor 41 and a vertical driving motor 51. The two driving motors 41 and 51 are connected to each other and to the machine housing 11 via a common motor carrier 61. As can be seen in FIG. 6, the telescopic carrier 52 starts from the motor carrier plate 61, passes through a wall of the machine housing 11 and mounts the housing 46 of the belt drive 47 on its top.

The deposit table 3 and the deposit plate 31 are height-adjustable via the vertical drive mechanism 5. The vertical drive mechanism 5 comprises the vertical driving motor 51 as well as the telescopic carrier 52, which is length-adjustable via the vertical driving motor.

Figure 2:
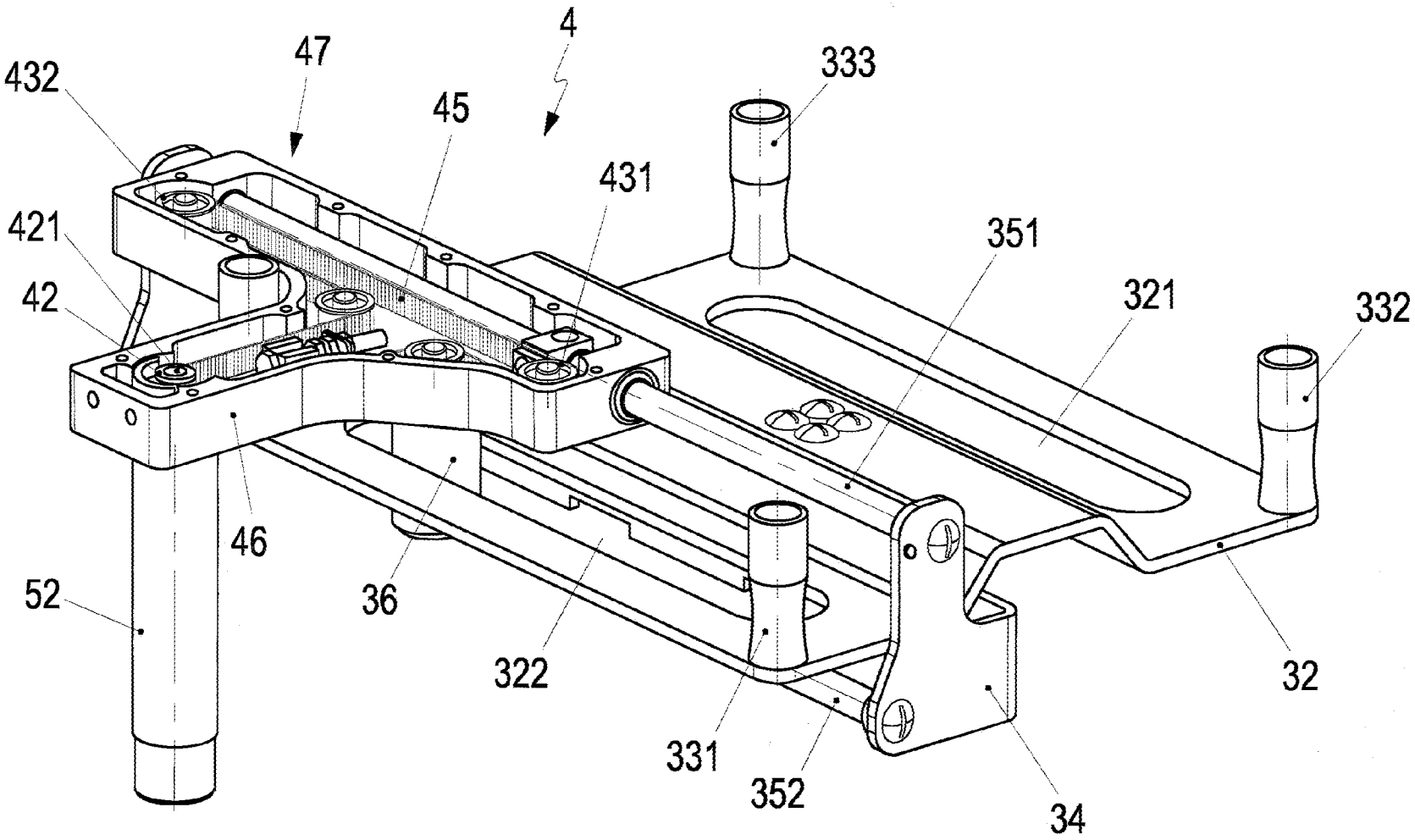
FIG. 2: a part of the table drive mechanism in a perspective representation
Figure 3:
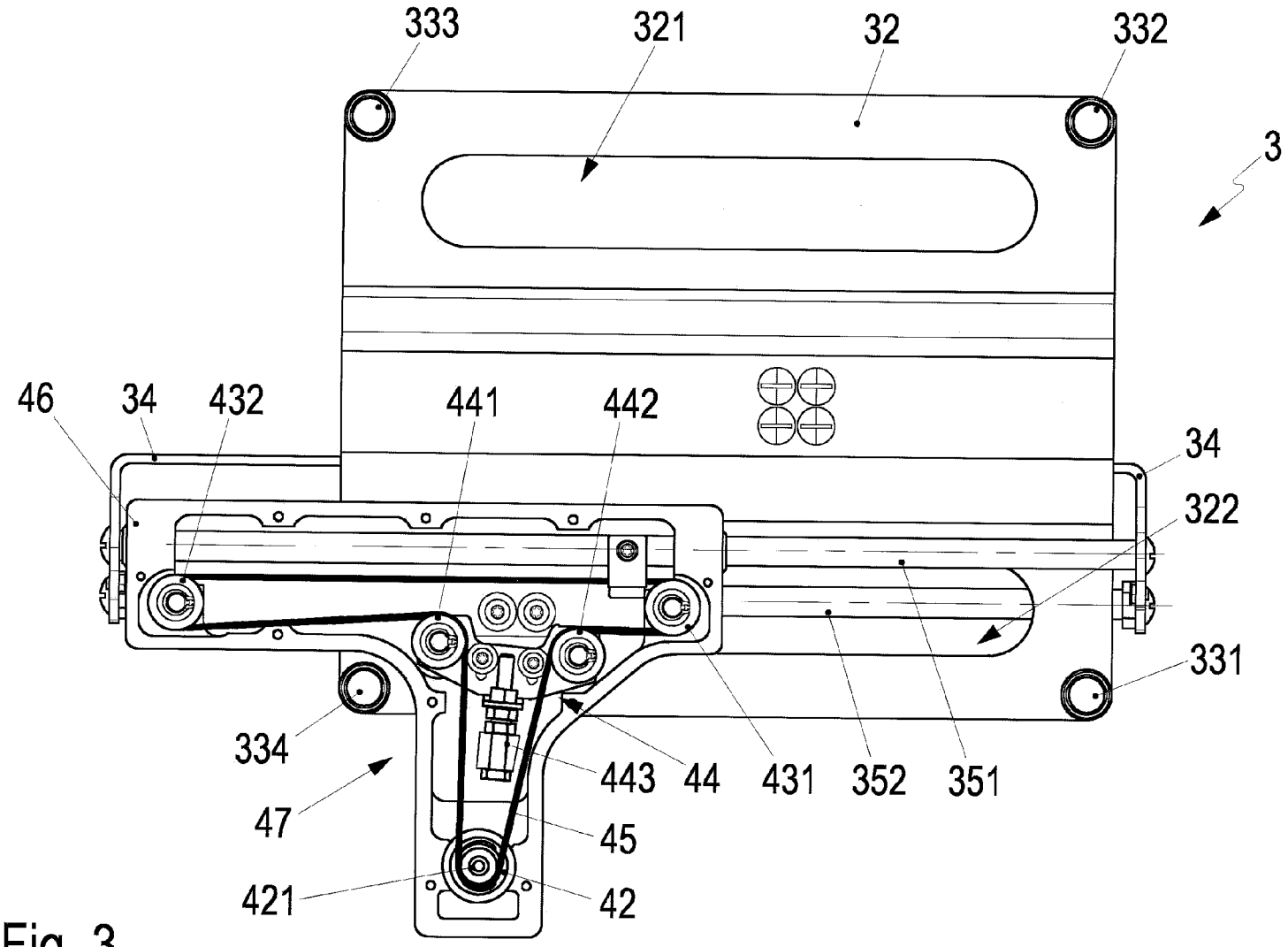
FIG. 3: a part of the table drive mechanism in top view in a first end position
Figure 4:
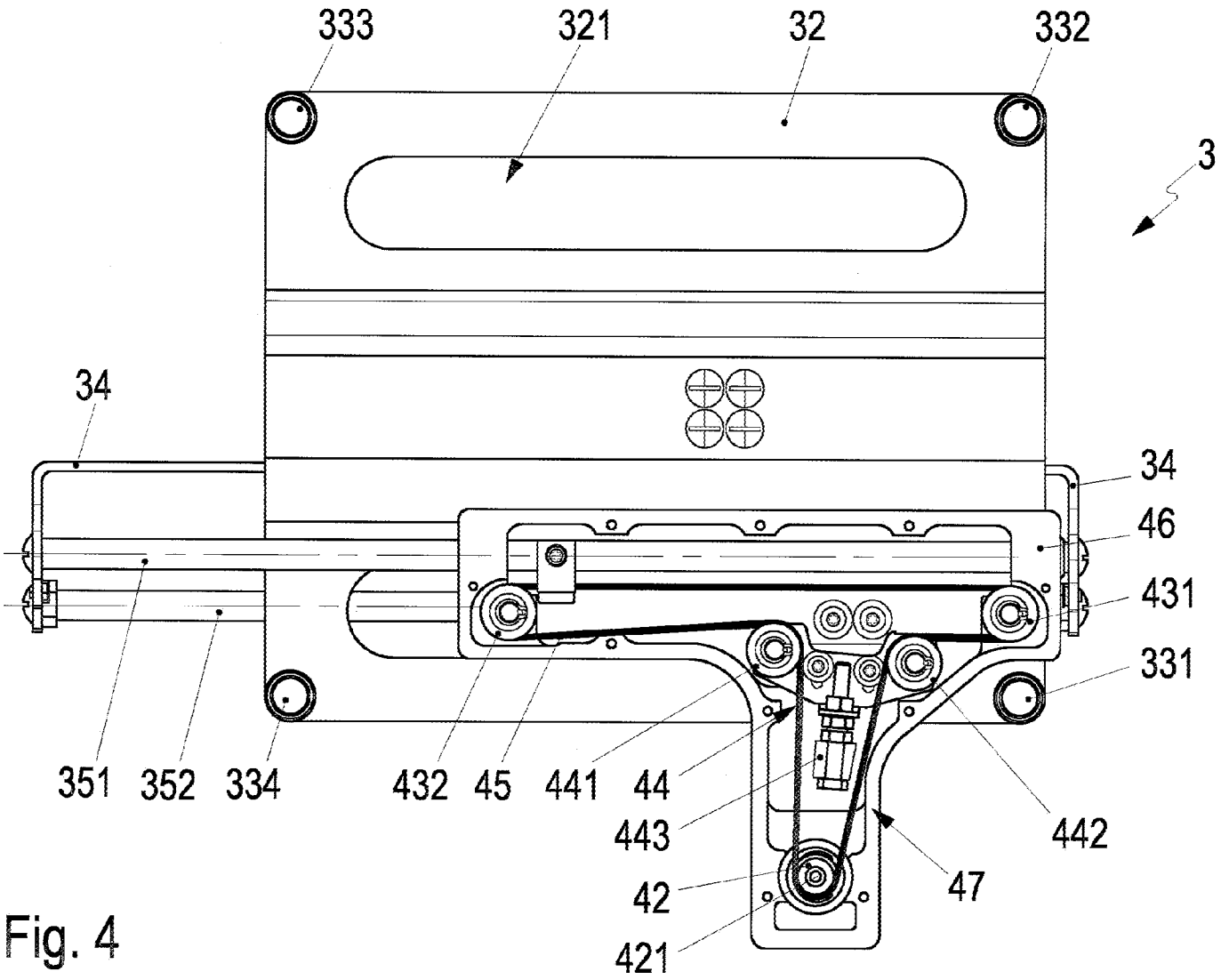
FIG. 4: a part of the table drive mechanism in top view in a second end position

Via the horizontal drive mechanism 4 represented for example in FIGS. 2 to 4, the deposit table 3 or the deposit plate 31 can be moved from a first end position, which is represented in FIG. 3, to a second end position, which is represented in FIG. 4. In FIG. 2, the horizontal drive mechanism is shown in a three-dimensional representation, wherein the cover of the housing 46 has been removed for the sake of clarity. In FIGS. 2-5, the removable deposit plate 31 has been removed for the sake of clarity.

The support profile 34 is mounted, so that it can be displaced linearly, via the two slide rods 351, 352 arranged spaced apart from each other vertically, on the housing 46 of the belt drive 47. The two rods 351 and 352 are offset relative to each other in a horizontal direction, wherein the upper slide rod 351 is connected to a run of the drive belt 45 of the belt drive 47 and the lower rod 352 is formed as a torque-absorbing rod, by the latter being braced, via a linear guide 36, outwardly against the housing 46 of the belt drive 47. The linear guide 36 has, on its underside, a recess 361 which is adapted to the contour of the rod 352 and in which the latter is guided so that it can be displaced linearly. The recess 361 grips around the rod 352 on three sides, as can be seen from FIG. 6. Shear forces can thereby be absorbed via the linear guide 36, with the result that torsion of the deposit table 3 is prevented.

The support profile 34 is further connected to the fixed side, or ground side, of the load cell 7. The load cell 7 is screwed on the support profile 34 with its ground side. The movable side, or force application side, of the load cell 7 carries the deposit plate carrier 32, by the latter being screwed to the force application side. The load cell 7 represents the only force-fit connection between the support profile 34 on the one hand and the deposit plate carrier 32 or the deposit plate 31 on the other hand. Force shunts, which could negatively affect the weighing result supplied by the load cell 7, are thereby avoided. In order to avoid such force shunts and additionally to cut down on weight, it is provided that the deposit plate carrier 32 has two slotted holes 321 and 322.

The deposit plate carrier 32 carries the holders 331, 332, 333, 334 and connects them to each other. The deposit plate carrier 32 is formed as a contoured, preferably folded, flat plate. In the middle, the deposit plate carrier 32 has an upwardly directed bulge 323, in which the load cell 7 is at least partially arranged.

The linear guide 36 is formed as a cylinder and, starting from the housing 46 of the belt drive 47, passes through a slotted hole 322 of the deposit plate carrier 32. The slotted hole 322 is dimensioned such that contact between the linear guide 36 and the deposit plate carrier 32 cannot occur in any of the horizontal positions.

The deposit plate 31 is designed substantially as a flat, rectangular plate. It has a flat surface for receiving the cut slices and/or stacks of slices. The deposit plate 31 is releasably connected to the deposit plate carrier 32 via the four holders 331, 332, 333, 334. The holders 331, 332, 333, 334 are in each case arranged in a corner of the deposit plate 31. They are formed as spacers in the form of cylindrical pins and extend in a vertical direction starting from the deposit plate carrier 32 to the deposit plate 31. The holders 331, 332, 333, 334 form an installation space B between the deposit plate 31 and the deposit plate carrier 32, as can be seen from FIG. 6. The holders 331, 332, 333, 334 in each case form releasable connections between the deposit plate 31 and the deposit plate carrier 32. The releasable connection can be formed as a magnetic coupling, snap-in coupling, plug-in coupling or screw coupling, or can have one of these. The connection between holder and deposit plate can thus be released without tools and in a short time.

The housing 46 of the belt drive 47 encroaches into the installation space of the deposit table defined by the holders. The housing 46 of the belt drive 47 encroaches directly between at least two of the holders 331, 334 of the four holders 331, 332, 333, 334. In each case one holder 331, 334 lies directly opposite a housing narrow side of the housing 46, as can be seen from FIGS. 3 and 4. In the first end position of the deposit table represented in FIG. 3, the holder 334 lies immediately neighboring and at only a short distance from the housing narrow side of the housing 46 lying opposite it. In the second end position represented in FIG. 4, the second holder 331 lies immediately neighboring and at only a short distance from the housing side lying opposite it. The deposit table 3 is moved by the horizontal drive mechanism 4 until one of the holders 331, 334 is located on a lateral housing narrow side of the housing 46 or rests against this.

As can be seen from FIG. 2 in a three-dimensional representation and from FIGS. 3 and 4 in the top view, the housing 46 of the belt drive 47 holds individual components of the horizontal drive mechanism 4. The driving roller 42, which is drive-connected to the horizontal driving motor 41 via the shaft 421, is mounted in the housing 46. The driving roller 42 meshes with the drive belt 45, which is guided in a T-shaped rotation inside the housing 46. A run of the drive belt 45 runs in parallel to the upper slide rod 351 and is drive-connected with the latter. A first deflection roller 431 and a second deflection roller 432, which guide the drive belt 45 in parallel to the upper slide rod 351, are mounted in the housing 46. Between the first deflection roller 431 and the second deflection roller 432, a tensioning device 44 for adjusting the belt tension is housed in the housing 46. The tensioning device 44 has a carrier plate, on which a third deflection roller 441 and a fourth deflection roller 442 are arranged, over which the drive belt 45 is likewise guided. The third and the fourth driving rollers 441, 442 can be adjusted together via a tensioning screw 443, in order to set the tension of the belt 45.

The housing 46 encloses these components of the horizontal drive mechanism 4 on all sides and has a removable cover, which has been removed in FIGS. 3 and 4 for the sake of clarity and thus is not represented.

The housing 46 has a passage opening for the slide rods 351 in each case on its two opposite housing sides. A sliding bushing which seals the opening and which guides the slide rods 351 so that they can be displaced linearly is arranged in this passage opening. Soiling is thereby effectively prevented from entering the belt drive 47.

As can be seen from FIG. 6, the belt drive 47 or the drive belt 45 encroaches into the installation space B arranged between the removable deposit plate 31 and the deposit plate carrier 32 and thus forms a compact and space-saving drive solution for the deposit table 3. As can further be seen from FIG. 6, the belt drive 47 or the housing 46 of the belt drive with the drive belt 45 is arranged in a plane flush with the holders 331, 332, 333, 334. The top or underside of the housing 46 runs in parallel to the deposit plate 31 and is arranged immediately underneath the latter, i.e. at a small distance from the deposit plate 31. A compact, driven deposit table is thus achieved which, despite the integrated drive components and load cell, has an overall height that is as small as possible.

The invention claimed is:

1. Slicing machine for elongated product to be sliced, with a driving motor which is housed in a machine housing and which drives a blade mounted on or in the machine housing, in order to cut slices off the elongated product to be sliced, wherein the machine housing comprises a deposit table arranged in a deposit area with a deposit plate carrier and a deposit plate, which can be removed therefrom, for depositing cut slices and a table drive mechanism with a horizontal drive mechanism, in order to move at least one of the deposit table or the deposit plate, motor-driven, linearly in at least one horizontal direction, wherein the horizontal drive mechanism has a belt drive with a drive belt, wherein the belt drive has at least two deflection rollers and a driving roller, which guide the drive belt in endless rotation in a horizontal plane, and wherein the driving roller is arranged offset from a plane that intersects a first deflection roller of the at least two deflection rollers and a second deflection roller of the at least two deflection rollers.

2. Slicing machine according to claim 1, wherein the deposit plate is spaced apart from the deposit plate carrier in a vertical direction, with the result that the deposit table has an installation space arranged between the deposit plate carrier and the deposit plate and at least one of the belt drive or the drive belt at least one of is arranged in the installation space or encroaches into the installation space.

3. Slicing machine according to claim 1, wherein the deposit plate carrier has at least two holders, which extend in a vertical direction starting from the deposit plate carrier and which releasably hold the deposit plate, the deposit plate at least one of (i) being able to be placed on the holders from above or (ii) being able to be at least one of releasably connected or coupled to one or more of the holders.

4. Slicing machine according to claim 3, wherein the belt drive has a housing which encloses the drive belt and the at least two deflection rollers and the driving roller.

5. Slicing machine according to claim 1, wherein the belt drive has a tensioning device for adjusting the tension of the drive belt with a third deflection roller and a fourth deflection roller, wherein at least one of the position of the third deflection roller or the position of the fourth deflection roller can be adjusted relative to the drive belt via a tensioning screw.

6. Slicing machine according to claim 4, wherein the table drive mechanism comprises a vertical drive mechanism, in order to alter, motor-driven, height of the deposit plate relative to the machine housing.

7. Slicing machine according to claim 6, wherein the vertical drive mechanism has a telescopic carrier and the housing of the belt drive is connected to the machine housing via the telescopic carrier, wherein the vertical drive mechanism has a vertical driving motor which is connected to the telescopic carrier such that the length of the telescopic carrier can be altered by a given motor.

8. Slicing machine according to claim 7, wherein the horizontal drive mechanism has a horizontal driving motor which is connected to the driving roller of the belt drive via a shaft, wherein the shaft is guided inside the telescopic carrier, and wherein the shaft is formed as a telescopic shaft.

9. Slicing machine according to claim 7, wherein the horizontal driving motor and the vertical driving motor are arranged underneath the deposit plate and housed in an internal space of the machine housing.

10. Slicing machine according to claim 1, wherein the deposit table has a support profile for holding the deposit carrier, and the deposit plate carrier is secured directly to the support profile, or wherein the deposit plate carrier is formed as one piece with the support profile.

11. Slicing machine according to claim 1, wherein the deposit table comprises a support profile and a load cell connected to the support profile and the deposit plate carrier is connected to a force application side of the load cell.

12. Slicing machine according to claim 11, wherein a central area of the deposit plate carrier has an upwardly directed bulge and the load cell is arranged such that the load cell at least partially encroaches into the space formed by the bulge.

13. Slicing machine according to claim 10, wherein the support profile is mounted on a housing of the belt drive so that the support profile can be displaced in a horizontal direction by means of two rods which are arranged spaced apart from each other in a vertical direction and running in parallel.

14. Slicing machine according to claim 13, wherein the upper rod is formed as a slide rod and is connected to a run of the drive belt and the lower rod is formed as a torque rod which absorbs or braces against a torque and which is mounted, so that the lower rod can be displaced, in a recess of a linear guide supported on the housing of the belt drive.

15. Slicing machine according to claim 1, wherein the slicing machine has a conveyor for the cut slices, in order to transport the cut slices, starting from the blade, in a horizontal direction transverse to a slicing plane defined by the blade, and at least one of an adjustable or programmable control device is connected to the horizontal drive mechanism and the conveyor and actuates the horizontal drive mechanism and the conveyor, to automatically deposit two-dimensional depositing shapes.

16. The slicing machine of claim 1, wherein the slicing machine is for food.

17. The slicing machine of claim 3, wherein the at least two holders includes three holders or four holders.

18. The slicing machine of claim 4, wherein at least one of the housing or the drive belt and the at least two deflection rollers and the driving roller are arranged in a horizontal plane flush with the at least two holders.

19. The slicing machine of claim 9, wherein the horizontal driving motor and the vertical driving motor are connected to each other via a common motor carrier and secured to the machine housing.

20. The slicing machine of claim 12, wherein the load cell is arranged with its upper edge inside the space formed by the bulge.

21. The slicing machine of claim 15, wherein the conveyor is formed as a chain frame with a flick ejector, and wherein the at least one of an adjustable or programmable control device is connected to and actuates the vertical drive mechanism.

* * * * *